US005718402A

United States Patent [19]

Hoffman et al.

[11] Patent Number: 5,718,402

[45] Date of Patent: Feb. 17, 1998

[54] POSTER GRIPPING EXTRUSION

[75] Inventors: Michael S. Hoffman; Sidney Rose, both of Marblehead, Mass.

[73] Assignee: Rose Displays Ltd., Marblehead, Mass.

[21] Appl. No.: 372,814

[22] Filed: Dec. 23, 1994

[51] Int. Cl.[6] ..... A47G 1/17

[52] U.S. Cl. ..... 248/205.3; 248/316.7; 40/656; 40/666

[58] Field of Search ..... 248/205.3, 316.7, 248/317, 231.81, 229.26, 229.17, 488, 490, 316.5, 231.51, 74.2; 40/618, 658, 617, 642, 656, 666

[56] References Cited

U.S. PATENT DOCUMENTS

| | | | |
|---|---|---|---|
| 2,826,387 | 3/1958 | Rutten | 248/229.26 |
| 3,324,585 | 6/1967 | Frederickson | 40/11 |
| 3,354,564 | 11/1967 | Falcone et al. | 40/658 |
| 3,497,074 | 2/1970 | Shaheen | 211/13 |
| 3,955,296 | 5/1976 | Kapstad | 40/11 |
| 4,315,611 | 2/1982 | Hoop | 248/317 |
| 4,341,028 | 7/1982 | Brown | 40/534 |
| 4,556,183 | 12/1985 | Greenberger | 248/221.4 |
| 4,882,862 | 11/1989 | Slavsby, Sr. | 40/324 |
| 5,145,140 | 9/1992 | Caston et al. | 248/205.3 |

OTHER PUBLICATIONS

IMAGO Display System Advertisement Sheet.

*Primary Examiner*—Leslie A. Braun
*Assistant Examiner*—Willie Berry, Jr.
*Attorney, Agent, or Firm*—Don Halgren

[57] ABSTRACT

The present invention comprises an elongated extruded plastic clip having a planar base portion joined to a planar leg in a parallel spaced apart manner. The leg and base are connected by a bridging portion. The leg has an elongated distal edge to which a curved clamp is attached. The clamp is secured to the leg by a flexible hinge. The clamp extends beyond the distal edge of the base to permit easy manual opening of the clamp and articulation thereof with respect to the base.

7 Claims, 1 Drawing Sheet

POSTER GRIPPING EXTRUSION

BACKGROUND OF THE INVENTION

1. Field of the Invention

This invention relates to gripping devices for securing posters or signs.

2. Prior Art

Retailers are constantly looking for new ways to hang signs or support posters for display cards from their shelves, cases, and ceilings.

There are a number of patents out there showing sign holding devices, but the applicability of those devices to a plurality of uses is limited. U.S. Pat. No. 3,324,585 to Frederickson shows a biasable clip, which actually lances the card which it is holding. A biasable panel is disposed in front of the card, but, the card may be damaged by the mere attempt to pull the panel away from the card. A further clip is shown in U.S. Pat. No. 3,354,564 to Falcone. This clip is actually a marking device which carries a plate on its front side thereof. The very thin clip is utilized to fit over the edge of a cup or bottle, the plate-like disc acting as a marker on the distal end of one of the legs.

U.S. Pat. No. 3,955,296 to Kapstad, shows a zigzag clip having a pair of angled tongues arranged to bias against a connecting member so as to engage the device on to a wall of a basket or the like. U.S. Pat. No. 4,341,028 to Brown, shows a card holding clip, one side of which is adaptable to be disposed about a vertical rod. U.S. Pat. No. 4,566,183 to Greenberger, shows a shelf attachable clip having a forward lip which defines in cross section, a generally J-shape to the clip. The clip has a rear portion which engages a particular channel groove which may be found on the edge of a shelf. U.S. Pat. No. 4,882,862 to Salbsky, Sr, shows a clip for mounting price cards upon container edges. This clip has a pair of legs, each of which are arranged in a curvilinear fashion. The clip is arranged to fit on the top of a bowl.

The prior art appears to be limited as to its versatility, as well as its being potentially harmful to the sign or poster that it may be carrying or it may be difficult for the user to control.

It is therefore an object of the present invention, to provide an elongated sign holding clip which may be utilized in a variety of configurations and circumstances.

It is a further object of the present invention, to provide a clip for holding signs or posters, wherein the clip will permit the user to engage a sign or a poster with the clip very easily, or disengage that sign or poster therefrom, without damaging that sign or poster.

BRIEF SUMMARY OF THE INVENTION

The present invention comprises an elongated extruded clip for holding cards or posters or the like. The elongated extruded clip which may be made in lengths of from about 50 centimeters to about 250 centimeters long or longer.

The elongated extruded clip has a first leg or planar base, having a width "w". The clip also comprises a second leg of planar elongated configuration, arranged parallel to the first leg, and attached thereto by a transversely disposed bridging portion extruded therebetween. The bridging portion also comprises one side of a channel member having a channel leg, the bridging portion and the channel leg being opened toward the planar base. The second leg has a distal edge which extends about half way down the width of the first leg or planar base.

An articulable clamp is attached to the distal edge of the second leg by a flexible living hinge which may be coextruded therewith during the extrusion process of the first and the second leg with the articulable clamp. The articulable clamp has a proximal portion of generally linear or planar configuration which mates with a distal portion of the second leg. The distal portion of the clamp has a cross-sectional configuration of an arc (curved), which is about a quarter of a circle. The arcuate, curvilinear or distalmost portion of the clamp extends beyond and overhangs past the distalmost edge of the first leg or planar base, to permit a user to lift up easily without damaging a poster pinched thereby. The juncture of the proximal portion of the articulable clamp with the arcuate curvilinear portion of the clamp, defines a line of contact between the first leg or the planar base, and the articulable clamp.

The articulable clamp is biased towards the first leg or planar base by its relationship and securement to the second leg through the flexible living hinge which is coextruded therewith. The proximal linear portion of the articulable clamp has an elongated flange portion arranged at an angle of about 135 degrees with respect to the plane of the proximal portion of the articulable clamp. The flange has a distalmost edge which provides a further line of contact between the flange (clamp) and the first leg or planar base.

The flange and the juncture between the proximal end and the distal portions of the articulable clamp therefore provide a pair of spaced apart parallel lines of contact which are biased against the first leg or planar base, and hence against any poster disposed therebetween, without puncture or damage thereto.

In operation, a poster or sign or card or the like would have a maximum thickness of no more than about 0.4 centimeters. That poster, card, or sign would be pushed into the thin gap between the first leg or planar base and the second leg, when the articulable clamp has been biased away from that first leg of planar base.

Rotation of that articulable clamp, which extends beyond the distal end of the first leg or planar base, about the flexible living hinge between the articulable clamp and the second leg, thus engages the card or poster between the first and second leg, and holds it therebetween with two spaced apart lines of contact pressure therealong.

The first leg or planar base has an outer surface on which double sided adhesive may be disposed. The double sided adhesive permits the outer surface of the leg or planar base to be arranged against any flat surface so as to permit the extruded elongated clip to hold a sign or poster therewith, in either a horizontal or vertical disposition.

The channel member configured adjacent to the bridging portion of the first leg and the second leg is arranged to receive a sliding support clip therein. The support clip may be hung from a suspension rod from a ceiling or an overhead support means.

BRIEF DESCRIPTION OF THE DRAWINGS

The objects and advantages of the present invention will become more apparent when viewed in conjunction with the following drawings, in which:

FIG. 1 is a perspective view of a pair of elongated extruded clips of the present invention supporting a poster there between;

DESCRIPTION OF THE PREFERRED EMBODIMENTS

Figure 1:
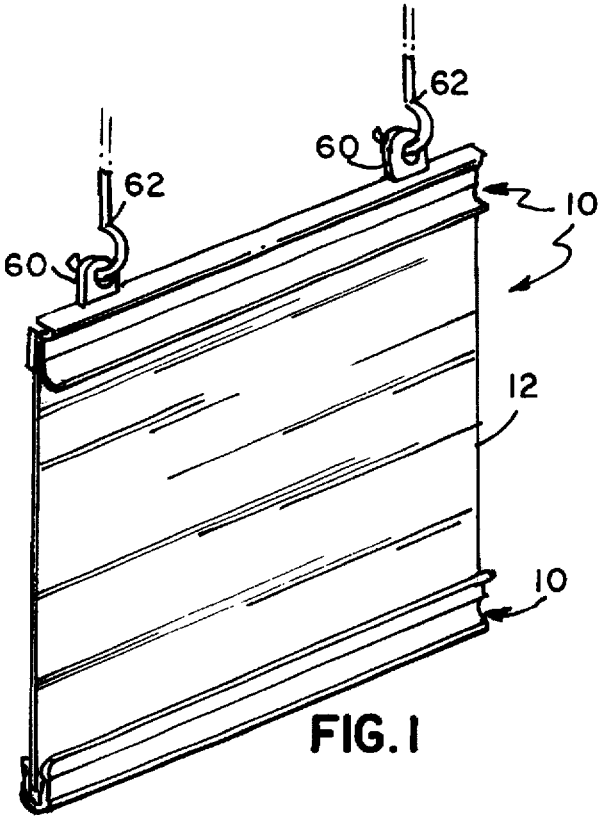

The present invention comprises an elongated extruded clip 10 for holding cards or posters 12 or the like, as shown in FIG. 1. The elongated extruded clip 10 may be made in long lengths of from at least about 50 centimeters to about 250 centimeters long, or even longer, so as to importantly be able to hold very long posters and the like.

Figure 2:
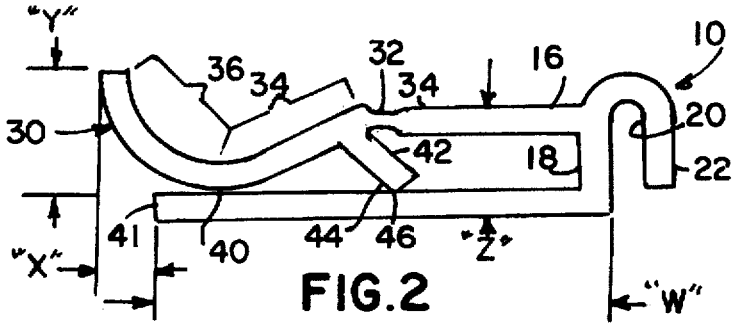
FIG. 2 is an end view of the elongated extruded clip shown in FIG. 1.

The elongated extruded clip 10 has a first leg or planar base 14, having a width 'w', as shown in FIG. 2, which width "W" may be 1.5 to 3 cms. or greater. The clip 10 also comprises a second leg 16 of planar elongated configuration, arranged parallel to the first leg 14, and attached thereto by a transversely disposed bridging portion 18 extruded therebetween. The bridging portion 18 also comprises one side of a channel member 20 having a channel leg 22, the bridging portion 18 and the channel leg 22 being open in a direction toward the planar base 14. The second leg 16 has a distal edge 24 which extends about half way down the width "W" of the first leg or planar base 14.

An articulable clamp 30 is attached to the distal edge 24 of the second leg 16 by a flexible living hinge 32 which may be coextruded therewith during the extrusion process of the first and the second legs, 14 and 16, and the articulable clamp 30. The articulable clamp 30 has a proximal portion 34 of generally linear or planar configuration which mates with a distal portion 36 of the clamp 30. The distal portion 36 of the clamp 30 has a curved cross-sectional configuration of an arc which is about a quarter of a circle, as shown in FIG. 2. The arcuate, curvilinear or distalmost portion 36 of the clamp 30, importantly extends beyond and overhangs past the distalmost edge 41 of the first leg or planar base 14 by a distance "X", which is at least about 0.5 cm., to permit the user to easily manually lift the curved clamp by its outer edge surface 31, from the base 14, or the poster, without damaging or smudging it. The elongated juncture of the proximal portion 34 of the articulable clamp 30 with the arcuate curvilinear portion 36, defines an elongated line of contact 40 between the first leg or the planar base 14, and the articulable clamp 30, which long line of contact is important to provide the holding power for securing long, large posters or the like.

The articulable clamp 30 is biased towards the first leg or planar base by its relationship and securement to the second leg 16 through the flexible "living" hinge which is coextruded therewith, and by the reaction with a flange member 42 rigidly extending from the proximal portion 34 thereof as shown in FIG. 2. The proximal linear portion 34 of the articulable clamp 30 has the elongated flange portion 42 arranged at an angle "M" of about 135 degrees with respect to the plane of the proximal portion 34 of the articulable clamp 30. The flange 42 has a distalmost edge 44 which provides a further elongated line of contact 46 between the flange 42 and the elongated first leg or planar base 14, for securely pinching a long poster arranged therebetween.

The flange 42 and the juncture between the proximal end and the distal portions 34 and 36 of the articulable clamp 30 therefore provide a pair of elongated, parallel, spaced apart lines of contact 40 and 46 which are biased against the first leg or planar base 14, so as to pinch a poster along two elongated parallel paths.

Figure 1A:
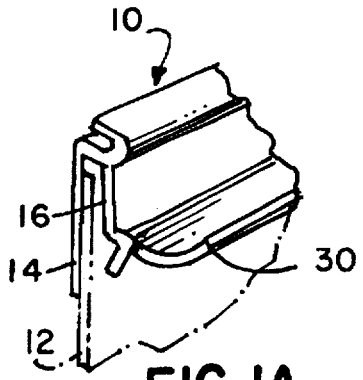
FIG. 1A is an enlarged view of a portion of the elongated extruded clip shown in FIG. 1.

In operation, a poster or sign or card 12, or the like, as shown in FIGS. 1 and 1A, which may have a maximum thickness of about 4 centimeters. That poster, card, or sign 12 would be pushed into the thin gap between the first leg or planar base 14 and the second leg 16, when the articulable clamp 30 has been biased away (lifted/pivoted) from that first leg of planar base 14.

Rotation of that articulable clamp 30, which extends beyond the distal end of the first leg or planar base 14, about the flexible living hinge 32 between the articulable clamp 30 and the second leg 16, as shown in FIG. 1A, thus engages the card or poster between the first and second leg 14 and 16, and holds it therebetween with its two spaced apart lines of contact therealong.

Figure 3:
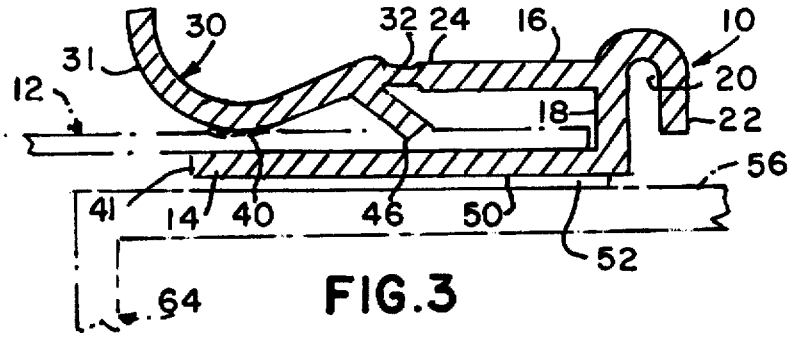
FIG. 3 is a sectional view of an extruded elongated clip shown with a different support arrangement therewith.

The first leg or planar base 14 has an outer surface 50 on which double sided adhesive tape 52 may be disposed, as shown in FIG. 3. The double sided adhesive tape 52 permits the outer surface 50 of the leg or planar base 14 to be arranged against any flat surface 56, as shown in phantom lines in FIG. 3, so as to permit the extruded elongated clip 10 to hold a sign or poster 12 therewith, in either a horizontal or vertical disposition.

The channel 20 configured adjacent to the bridging portion 18 of the first leg 14 and the second leg 16 is arranged to receive a sliding support clip 60 therein, as may be seen in FIG. 1. The support clip 60 may be hung from suspension rods 62 from a ceiling or an overhead support means, not shown. The clips 60 have an extended tab, not shown, which matingly slide into the channel 20 so as to permit the poster 10 to be supported in a vertical disposition, with a further extruded clip 10 acting as an unobtrusive "weight" means, to keep the poster 12 from bending or curling as it is supported on the support rods 62 suspended from a ceiling of the like.

It is to be noted that the surface 56 shown on FIG. 3, would be on a cross-section of a vertically disposed post 64, which shows how this same clip 10 may hold a poster (relatively rigid) out to the side. That is, the extruded clip 10 secures a vertical side of the poster 12, not its upper or lower horizontal edge.

Thus what has been shown is a novel extruded clip which has a flexible hinge co-extruded with the gripping and base portions thereof, the clip portion therewith which includes an overhanging distal lip to permit easy manipulation of the clamp by the manual grasping of a user in his/her engagement and disengagement of a poster in the extruded clip.

We claim:

1. An elongated extruded plastic clip for securing signs in a viewable orientation, permitting a holding of said sign from a side edge thereof, or a horizontal edge thereof, comprising:

a planar base having an extended length and a first width;

a leg arranged parallel to said base, said leg of narrower width then said first width of said base and having a distal edge disposed at about a mid-point of said base, said leg and said base being connected by a bridging portion;

a "U"-shaped channel having a pair of channel legs, one of which comprises said bridging portion;

an articulable clamp flexibly attached to said distal edge of said leg and arranged to extend beyond the distal edge of said base, to provide a gripping arrangement for a sign between said clamp and said base.

2. An elongated extruded plastic clip as recited in claim 1, wherein said leg and said base are spaced apart so as to provide a receiving slot for any sign edge disposed therein.

3. An elongated extruded plastic clip as recited in claim 2, wherein said clamp has a proximal portion and a distal portion, said distal portion having a curvilinear configuration to permit gripping and lifting of said clamp.

4. An elongated extruded plastic clip as recited in claim 3, wherein said proximal portion of said clamp has a linear flange extending into said slot and against said base.

5. An elongated extruded plastic clip as recited in claim 3, wherein said curvilinear portion of said clamp extends through an arc of about 90 degrees.

6. An elongated extruded plastic clip as recited in claim 3, wherein said channel is arranged to receive a holding clip to permit said extruded plastic clip to be supported in a horizontal disposition from an overhead support.

7. An elongated extruded plastic clip as recited in claim 3, wherein said base has an outer planar surface, having an adhesive thereon, to permit said extruded clip to be adhesively secured to any further object so as to support a sign in a vertical or horizontal disposition thereby.

* * * * *